US007062206B2

(12) United States Patent
Fujii et al.

(10) Patent No.: US 7,062,206 B2
(45) Date of Patent: Jun. 13, 2006

(54) TONER SUPPLYING APPARATUS AND IMAGE FORMING APPARATUS

(75) Inventors: Ritsuo Fujii, Hachioji (JP); Seiji Yamaguchi, Hachioji (JP); Hiroshi Isokawa, Hachioji (JP); Yasuo Shiokawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 91 days.

(21) Appl. No.: 10/804,164

(22) Filed: Mar. 19, 2004

(65) Prior Publication Data

US 2004/0247344 A1 Dec. 9, 2004

(30) Foreign Application Priority Data

Jun. 9, 2003 (JP) ..... 2003-163521

(51) Int. Cl.
*G03G 15/08* (2006.01)

(52) U.S. Cl. ..... 399/258

(58) Field of Classification Search ..... 399/258, 399/260, 252–255, 262, 292
See application file for complete search history.

(56) References Cited

U.S. PATENT DOCUMENTS 5,652,947 A * 7/1997 Izumizaki ..... 399/58
5,950,055 A * 9/1999 Yahata et al. ..... 399/252
6,115,574 A * 9/2000 Mikuriya ..... 399/258
6,829,463 B1 * 12/2004 Fujii et al. ..... 399/258
2003/0142999 A1 * 7/2003 Fujii et al. ..... 399/258
2003/0235435 A1 * 12/2003 Muramatsu et al. ..... 399/258
2004/0105704 A1 * 6/2004 Yamauchi et al. ..... 399/258
2005/0041998 A1 * 2/2005 Fujii et al. ..... 399/258
2005/0117920 A1 * 6/2005 Ogata et al. ..... 399/27
2005/0123323 A1 * 6/2005 Koyama et al. ..... 399/258
2005/0163537 A1 * 7/2005 Muramatsu et al. ..... 399/258

FOREIGN PATENT DOCUMENTS

JP 11-242416 9/1999

* cited by examiner

*Primary Examiner*—Yaritza Guadalupe
(74) *Attorney, Agent, or Firm*—Finnegan, Henderson, Farabow, Garrett & Dunner, L.L.P.

(57) ABSTRACT

A toner supplying apparatus for feeding a toner to a developing device to develop a latent image on an image bearing member. The apparatus includes: a toner separating member communicating to the developing device, to separate the toner from the mixed fluid containing the toner and an air stream; a separating side flow control mechanism disposed between the toner separating member and the developing device; a wall to cover at least a portion of the flow control mechanism, having a clearance therebetween; and an after-separation storage to store the toner separated from the mixed fluid.

31 Claims, 6 Drawing Sheets

TONER SUPPLYING APPARATUS AND IMAGE FORMING APPARATUS

BACKGROUND

1. Technical Field

The invention relates to a toner supplying apparatus in an electrophotographic system of image forming apparatus, and to an image forming apparatus.

2. Related Art

The image forming apparatus has a problem of a difficulty from a mechanical space point of view in disposing a toner storage for storing a toner in the vicinity of a developing device because of a large volume of the storage.

In order to solve such a problem, a toner supplying technology has been disclosed for transferring the toner from the toner storage to the developing device by using a toner transferring method called an air-transfer that can transfer the toner far.

The toner supplying apparatus using the air-transfer method basically includes a toner storage having a toner mixing chamber, a fluid transferring member for transferring mixed fluid of the toner and air-stream from the toner storage, and a toner separating member for separating the toner from the transferred mixed fluid.

A part of the air-stream separated from the toner is usually returned to the mixing chamber via the fluid transferring member without discharging outside. Sometimes the toner separating member has been provided with a filter for preventing the toner from scattering outside and for releasing only a part of the air-stream outside to adjust the air pressure within a supply path. There has been also disclosed a technology of returning the air-stream in a developing device to a toner supplying apparatus passing through a transferring pipe between the developing device and the toner supplying apparatus, or a technology of returning the air-stream outside through a filter provided on a developing device. Further disclosed is a technology in which a bladed wheel called a rotary valve and a seal are provided between a developing device and a mixed fluid transferring part to avoid toner scattering from the developing device (for example, JP-Tokukaihei-11-242416A).

However, in the method of returning the air-stream in the developing device to the toner supplying apparatus through the transferring pipe connecting between the supplying apparatus and the developing device, if the transferring pipe is long, air-flow resistance inside the transferring pipe increases so that the air-stream within the developing device cannot return to the toner supplying apparatus in a short time, thereby there is a large possibility of scattering the toner from the developing device.

In the method of providing the developing device with a filter to release the air-stream to the outside, the filter needs to be exchanged periodically, which is troublesome, and missing the periodic exchange of filter causes the filter to be clogged to prohibit the air-stream from passing through the filter, thereby scattering the toner from the developing device may cause.

In the method of providing the rotary valve and the seal between the developing device and the fluid transferring part, long-time rotation of the bladed wheel of the rotary valve causes the toner to enter a sliding part between the edges of the blades and the seal with resultant melting and sticking of the toner.

SUMMARY

The first aspect is a toner supplying apparatus for supplying a mixed fluid containing a toner and an air stream to a predetermined position, comprising: a toner separating member communicating to a developing device to develop a latent image on an image bearing member, which separates the toner from the mixed fluid; a separating side flow control mechanism disposed between the toner separating member and the developing device; a wall to cover at least a portion of the flow control mechanism, having a clearance therebetween; and an after-separation storage to store the toner separated from the mixed fluid.

The second aspect is a toner supplying apparatus for feeding a mixed fluid containing a toner and an air stream from a toner storage through a first supply path, by a first supply member, which comprises: the toner storage including: a toner hopper; a mixing chamber; a storage side flow control mechanism disposed between the toner hopper and the mixing chamber; and a wall to cover at least a portion of the storage side flow control mechanism, having a clearance therebetween.

The third aspect is a toner supplying apparatus for feeding a mixed fluid containing a toner and an air stream from a toner storage which is disposed at a distance from a developing device, to a predetermined position through a first supply path, by a first supply member, comprising: a toner separating member which is disposed near the developing device, to communicate to the developing device and to separate the toner from the mixed fluid; a first valve including a movable member covered by a wall, disposed between the toner separating member and the developing device; and a second valve including a movable member covered by a wall, disposed between a toner hopper in the toner storage and a toner mixing chamber.

The fourth aspect is a image forming apparatus comprising: a photoreceptor; a developing device to develop a latent image on the photoreceptor with a toner; a transferring device to transfer developed toner to an image support; a fixing device to fix the toner on the image support; and a toner supplying apparatus of the first aspect.

By these aspects, the advantage of a reliable toner supply to a developing device may be obtained.

BRIEF DESCRIPTION OF THE DRAWINGS

The invention can be fully understood with reference to the following detailed description and the accompanying drawings, in which.

PREFERRED EMBODIMENTS OF THE INVENTION

Figure 1:
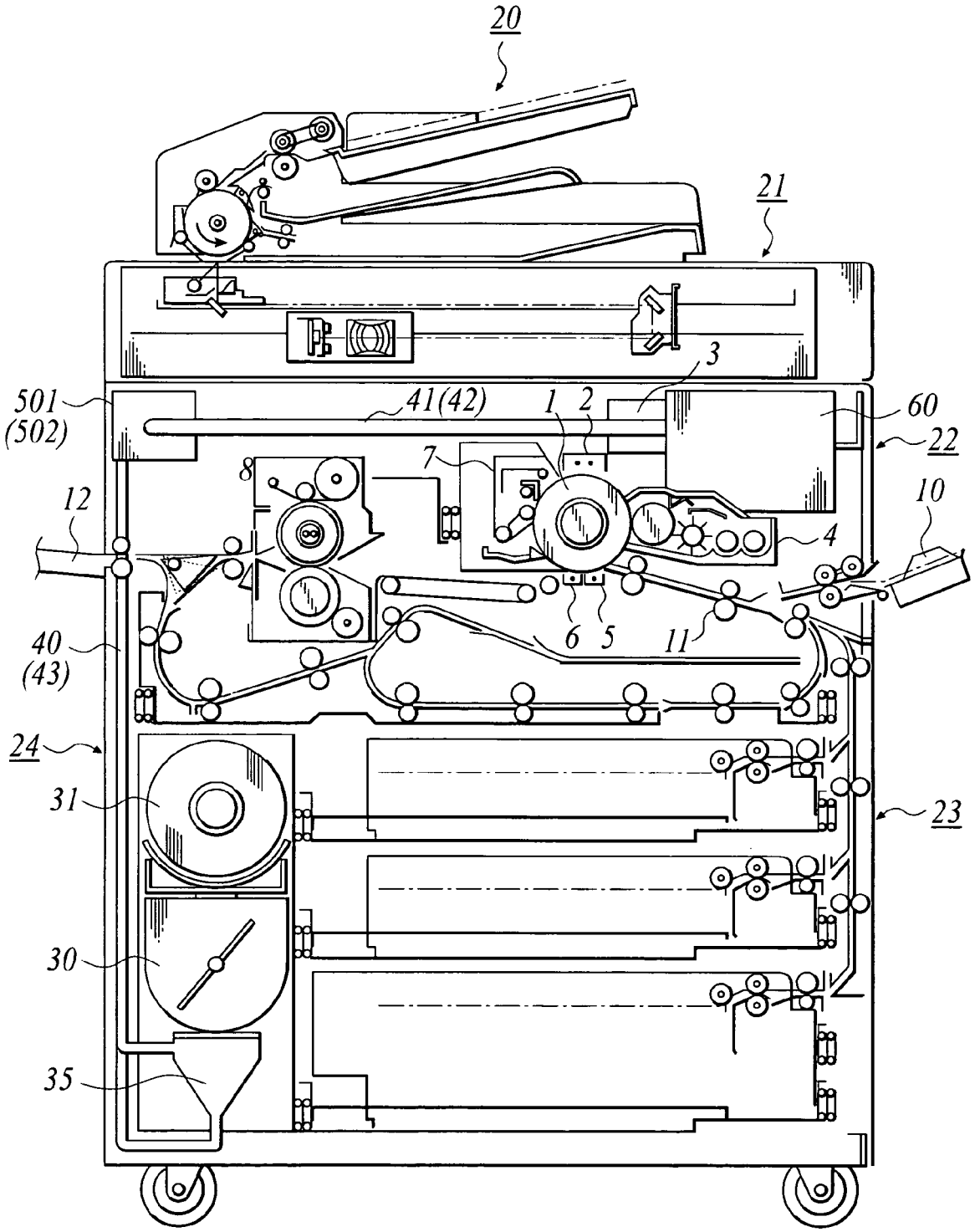
FIG. 1 is a schematic illustration showing the overall construction of an image forming apparatus including a toner supplying apparatus according to a first embodiment of the present invention.

The first aspect is a toner supplying apparatus for supplying a mixed fluid containing a toner and an air stream to a predetermined position, comprising: a toner separating member communicating to a developing device to develop a latent image on an image bearing member, which separates the toner from the mixed fluid; a separating side flow control mechanism disposed between the toner separating member and the developing device; a wall to cover at least a portion of the flow control mechanism, having a clearance therebetween; and an after-separation storage to store the toner separated from the mixed fluid.

In the first aspect, preferably, the separating side flow control mechanism is a separating member side valve which comprises a movable member capable to reduce the air stream entering into the developing device and a shaft which the movable member can move based on. In the apparatus, the movable member is preferably arranged to have a clearance of 0.1 mm to 0.7 mm between the wall and the movable member when an end of the movable member locates at a position closest to the wall.

The separating side flow control mechanism preferably includes a bladed wheel having a plurality of blades, a screw or a gate valve. Preferably, the bladed wheel having blades, or the screw is arranged to have a clearance of 0.1 mm to 0.7 mm between the wall and the movable member when an end of the blades or an end of the screw locates at a position closest to the wall.

The separating side flow control mechanism may be a bladed wheel having 4–12 blades. The apparatus of the first aspect, may comprise at least two separating side flow control mechanisms. The apparatus may comprise at least two separating side flow control mechanisms in series.

The apparatus of the first aspect, may comprise: a mixing chamber for mixing the toner and the air stream; a first supply member to supply the mixed fluid containing the toner and the air stream to the toner separating member; a first supply path for guiding the mixed fluid to the toner separating member; a second supply member to return the toner which was not separated at the toner separating member, to the mixing chamber; and a second supply path for guiding the toner which was not separated to the mixing chamber. The toner separating member is preferably arranged near the developing device. The apparatus may further comprise a supply member for supplying the toner separated from the mixed fluid to the separating side flow control mechanism, and the separating side flow control mechanism is driven at precisely or approximately the same time that the supply member is driven.

The second aspect is a toner supplying apparatus for feeding a mixed fluid containing a toner and an air stream from a toner storage to a predetermined position through a first supply path, by a first supply member, which comprises: the toner storage including: a toner hopper; a mixing chamber; a storage side flow control mechanism disposed between the toner hopper and the mixing chamber; and a wall to cover at least a portion of the storage side flow control mechanism, having a clearance therebetween.

In the apparatus of the second aspect, preferably, the storage side flow control mechanism comprises a movable member to capable to reduce the mixed fluid entering into the mixing chamber and a shaft which the movable member can move based on. The movable member is preferably arranged to have a clearance of 0.1 mm to 0.7 mm between the wall and the movable member when an end of the movable member locates at a position closest to the wall. The storage side flow control mechanism may include a bladed wheel having a plurality of blades, a screw or a gate valve. The bladed-wheel having blades, or the screw is preferably arranged to have a clearance of 0.1 mm to 0.7 mm between the wall and the movable member when an end of the blades or an end of the screw locates at a position closest to the wall. The apparatus of the second aspect may comprise at least two storage side flow control mechanisms. The apparatus may comprise: a mixing chamber for mixing the toner and the air stream; a first supply member to supply the mixed fluid containing the toner and the air stream to a toner separating member; a first supply path for guiding the mixed fluid to the toner separating member; a second supply member to return the toner which was not separated at the toner separating member, to the mixing chamber; and a second supply path for guiding the toner which was not separated to the mixing chamber. The toner separating member is preferably arranged near the developing device. The apparatus may further comprise: a supply member to supply the toner separated from the mixed fluid to the storage side flow control mechanism, and the storage side flow control mechanism is driven at precisely or approximately the same time that the supply member is driven. The toner hopper may comprise a sensor for detecting an amount of toner in the toner hopper, and the toner storage comprises a detachable toner container which supplies toner stored therein into the toner hopper when the sensor detects a predetermined level of the amount of toner in the toner hopper.

The third aspect is a toner supplying apparatus for feeding a mixed fluid containing a toner and an air stream from a toner storage which is disposed at a distance from a developing device, through a first supply path, by a first supply member, comprising: a toner separating member which is disposed near the developing device, to communicate to the developing device and to separate the toner from the mixed fluid; a first valve including a movable member covered by a wall, disposed between the toner separating member and the developing device; and a second valve including a movable member covered by a wall, disposed between a toner hopper in the toner storage and a toner mixing chamber.

In the apparatus of the third aspect, each of the first and second valves may comprise a movable member capable to reduce the air stream entering into the developing device and a shaft which the movable member can move based on. Each of the first and second valves is preferably arranged to have a clearance of 0.1 mm to 0.7 mm between the wall and the movable member when an end of the movable member locates at a position closest to the wall. Each of the first and second valves may include a bladed wheel having a plurality of blades, a screw or a gate valve. The bladed wheel having blades, or the screw is preferably arranged to have a clearance of 0.1 mm to 0.7 mm between the wall and the movable member when an end of the blades or an end of the screw locates at a position closest to the wall. The apparatus of the third aspect, may comprise at least two first valves each including the movable member, and at least two second valves each including the movable member. The apparatus may comprise at least two first valves in series, and at least two second valves in series.

The fourth aspect is a image forming apparatus comprising: a photoreceptor; a developing device to develop a latent image on the photoreceptor with a toner; a transferring device to transfer developed toner to an image support; a fixing device to fix the toner on the image support; and a toner supplying apparatus of the first aspect.

A first embodiment of the toner supplying apparatus will now be described with reference to the drawings. The description of the embodiment should not limit the scope of the invention.

FIG. 1 is a schematic illustration showing the overall construction of an image forming apparatus equipped with the toner supplying apparatus.

In an automatic document feeding device 20 of FIG. 1, documents placed on a document table are fed one by one to a reading position, and stacked in a document discharge tray after reading the documents.

A document reading section 21 reads an image on a document and produces digital image data.

An image forming section 22 forms an image on a recording sheet using an electro-photographic method.

In the image forming section 22, there are arranged around a drum-like photosensitive body (image bearing member) 1; a charging device 2, an exposing device 3, a developing device 4, a transferring device 5, a detaching device 6 and a cleaning device 7. Under the image forming device 22, there is provided a paper feed section 23 including a plurality of recording sheets storages, from which a recording sheet is transferred to the image forming section 22. Reference numeral 10 denotes a paper feed section for manual feeding. A recording sheet fed from the paper feed sections 23 or 10 is supplied by registration rollers 11 to a position between the photosensitive body 1 and the transferring device 5, applied a fixing process by a fixing device 8, and discharged to a discharging tray 12.

Corresponding to the clockwise rotation of the photosensitive body 1, the body 1 is charged by the charging device 2, exposed an image by the exposing device 3, and developed by the developing device 4, whereby a toner image is formed on the body 1. The formed toner image is then transferred on the recording sheet by the transferring device 5. The recording sheet with the toner image transferred thereon is fixed by the fixing device 8, and then discharged to the discharging tray 12.

The developing device 4 develops an electrostatic latent image on the photosensitive body 1, using a two-component developer composed of a toner and a carrier or a mono-component developer that contains a toner without a carrier or contains a toner and additives. The developing device 4 stores a predetermined amount of developer, and the toner consumed by the development is replenished from a toner storage (to be explained below) 24 of the toner supplying apparatus to maintain the toner concentration of the developer in the device 4 to a predetermined value. When using the mono-component toner, the developer amount in the developing device is maintained to the predetermined value with the similar toner replenishment method.

The toner storage 24 is disposed apart from a toner separating member 60 that locates at the developing device 4 or near the developing device 4, and connected to the separating member 60 with transferring pipes 40–43 acting as toner transporting conduits or a first supply path and a second supply path. Each of the transferring pipes 40–43 is composed partly of a flexible member made of silicone rubber or fluorocarbon resin, and partly of a metal pipe. The toner storage 24 includes a toner hopper 30 and a funnel-like mixing chamber 35 for mixing the toner and the air-stream, and a toner container 31 mounted thereon.

The toner supplying apparatus will now be explained with reference to FIGS. 2 and 3.

Figure 2:
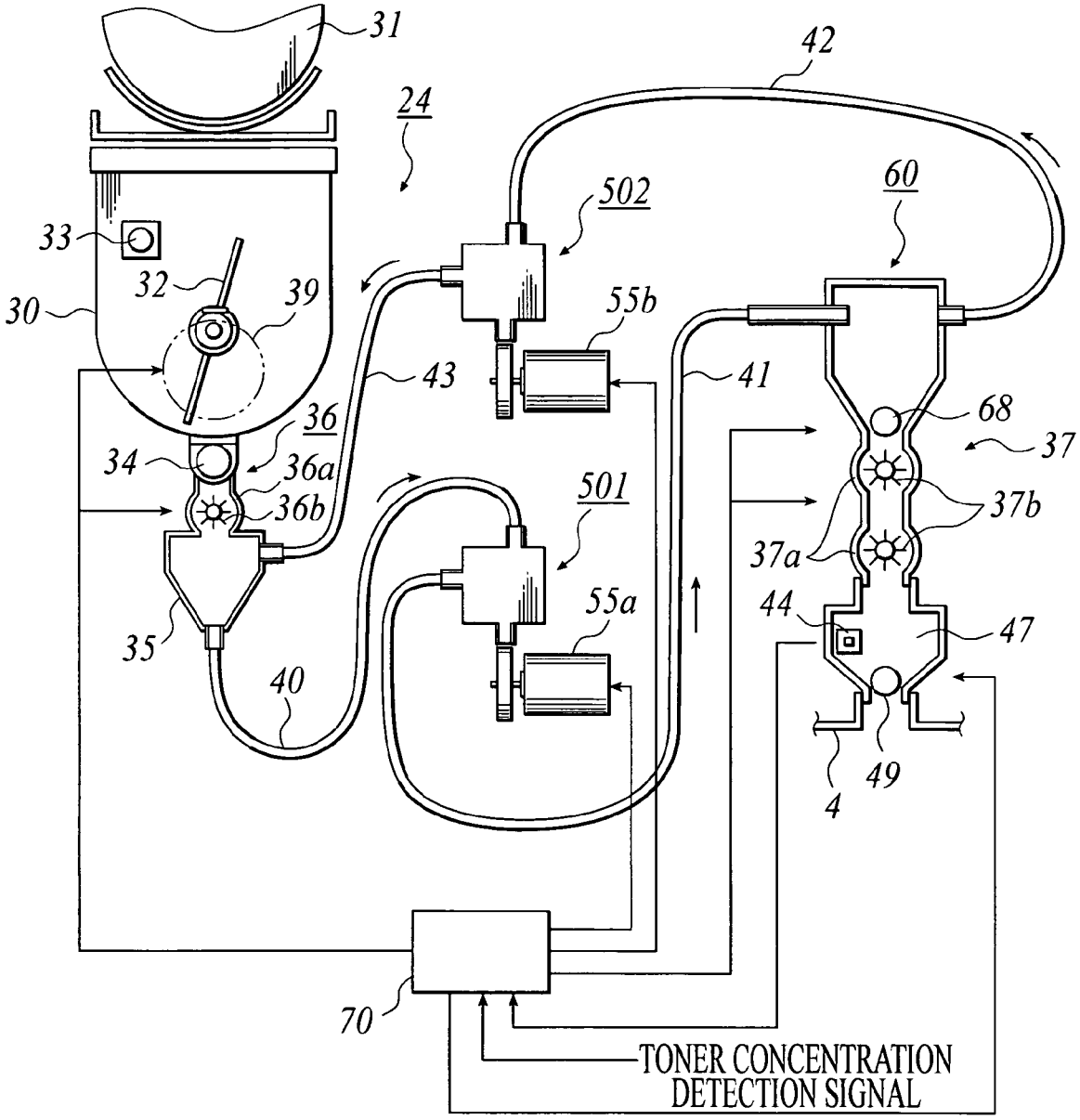
FIG. 2 illustrates the toner supplying apparatus in the image forming apparatus shown in FIG. 1.
Figure 3:
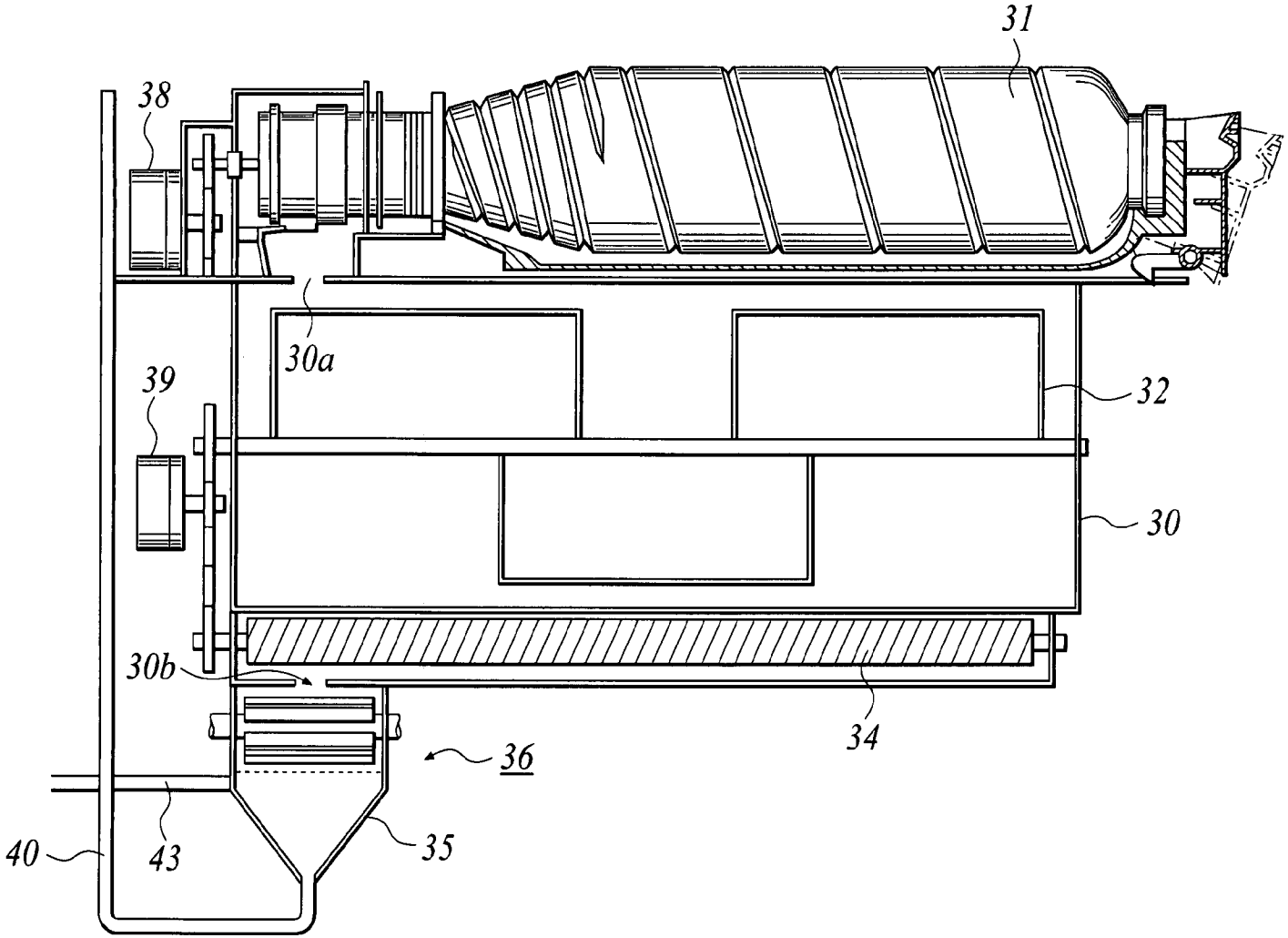
FIG. 3 illustrates a toner storage.

FIG. 2 illustrates the toner supplying apparatus used in the image forming apparatus shown in FIG. 1, and FIG. 3 illustrates the toner storage.

Referring to FIG. 2, the toner supplying apparatus includes the toner storage 24, a pump 501 as a fluid transferring member for supplying the toner constituting a first supply device, a pump 502 as a fluid transferring member for returning the toner constituting a second supply device, the toner separating member 60 and the transferring pipes 40–43 acting as toner transporting conduits.

Referring to FIG. 3, the cylindrical toner container 31 is mounted on the toner storage 24 (see FIGS. 1 and 2), and rotated by a motor 38, which causes the toner to fall from the container 31 into the toner hopper 30 through an opening 30*a* (the toner is mixed with the air and stored in the toner container). The toner hopper 30 includes a bar-type stirring member 32 having a plurality of channel-shaped parts formed thereon, and a feeding screw 34 disposed at the lower part.

The amount of toner in the toner hopper 30 is detected by a toner sensor 33 using a piezoelectric element. When a toner level becomes lower than the predetermined level set in the sensor 33, the motor 38 is actuated to rotate the container 31, which causes the toner to be replenished into the hopper 30 through the opening 30*a*.

Rotation of a motor 39 causes the stirring member 32 and the screw 34 to rotate to fall the toner from the hopper 30 into the mixing chamber 35 through an opening 30*b*.

Between the opening 30*b* and the mixing chamber 35, there is provided a movable valve or a rotary valve 36 (to be described later) acting as a flow control mechanism.

The air flows into the mixing chamber 35 through the transferring pipe 43 to mix the air-stream and the toner to form mixed powder (mixed fluid).

Figure 4:
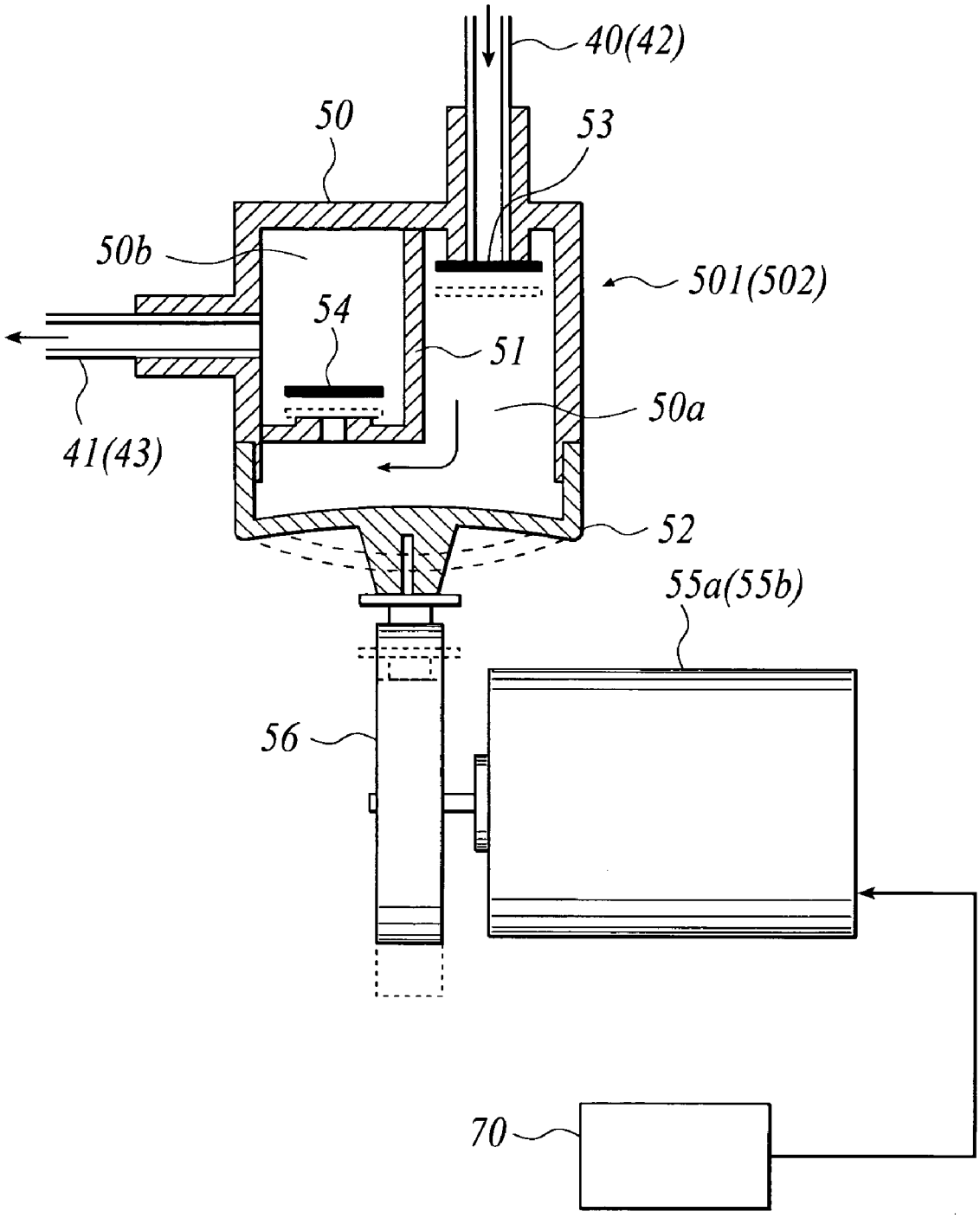
FIG. 4 is a sectional view showing the construction of a diaphragm pump.

FIG. 4 is a sectional view showing the structure of a diaphragm pump.

As for the fluid transferring member for supplying (returning) toner, the diaphragm pumps 501 and 502 shown in FIG. 4 are employed, but there may be employed any known pumps, such as a screw pump disclosed in JP-Tokukaihei-7-219329A, funs, or the like. The pump 501 constitutes the fluid transferring member for supplying the toner as the first supply device for feeding the mixed fluid from the mixing chamber 35 to the toner separating member 60 (see FIG. 2), and the pump 502 constitutes the fluid transferring member for returning the toner with air-stream, which is not separated, from the toner separating member 60 to the mixing chamber 35. In the embodiment shown in FIG. 2, the same structure of pumps are used for the pumps 501 and 502, but the fluid transferring member for supplying the toner may differ from that for returning the toner.

The pumps 501 and 502 will be explained referring to FIG. 4. Both pumps have the same structure.

The pump 501 is connected at its inlet with the pipe 40 as a first supply path, and at its outlet with the pipe 41 as the first supply path. The pump 502 is connected at its inlet with the pipe 42 as a second supply path, and at its outlet with the pipe 43 as the second supply path. A pump chamber enclosed by an outer wall 50 is partitioned into a suction chamber 50*a* and a discharge chamber 50*b* by an inside wall 51. At an inlet of the suction chamber 50*a*, a valve 53 is provided, and at a vent of the discharge chamber 50*b* (a vent on the inside wall 51), a valve 54 is provided.

The mixed fluid, mixture of the toner and air-stream, is transferred to the toner separating member 60 through the pipe 41, and the toner separated from the mixed fluid is transferred to a toner storing buffer 47 as an after-separation storage depending on the rotation of a screw 68 and a rotary valve 37.

The toner storing buffer 47 is provided with a piezoelectric sensor 44 to keep the toner amount constant. Detection of the toner level being lowered actuates the pump and the like to replenish the toner therein, the toner being separated from the mixed fluid at the separating member 60.

A part of outer housing of the pump 501 (502) is formed with a diaphragm 52 made of elastic material like rubber. The diaphragm 52 is driven by an eccentric rotating member 56, which is driven by a motor 55*a* (55*b*), to be transformed between the states indicated by solid lines and broken lines.

The rotation of the eccentric rotating member 56 by the motor 55*a* (55*b*) causes the diaphragm 52 to be transformed between the states indicated by solid lines and broken lines, whereby the volume of the suction chamber 50*a* changes so as to increase or decrease the pressure of the chamber 55*a*. This increase or decrease of the pressure causes the valves 53 and 54 to move between the positions indicated by solid lines or broken lines, to thereby feed the fluid to a one-side direction shown by an arrow.

In a conventional technique, fluctuation of the rotational speed of the motor 55*a* (55*b*) or the like sometimes causes to lose a pressure balance between the pipe 41 side and the pipe 42 side. In order to reduce this pressure change, the toner separating member 60 has been provided with a filter in the past to release a part of the air-stream outside to adjust the air pressure. However, as described before, clogging of the filter in a shot term causes the occurrence of toner scattering, which requires the periodic exchange of filter, troublesome operation.

Further, when the toner transferring pipes are long, higher air-flow resistance in the pipes needs to be used large capacity motors, but sometimes causes the air-stream to flow backward into the hopper 30, or to leak into the developing device, to thereby scatter the toner.

In order to reduce the influence of aforementioned pressure change in the toner streaming path, the embodiment provides a rotary valve in the toner streaming path as a flow control mechanism, and feeds the toner by rotating a bladed wheel in the valve when necessary.

A description will be given of the rotary valve as a flow control mechanism.

As shown in FIG. 2, a rotary valve 36 acting as a storage side stream restricting mechanism is disposed between the toner hopper 30 and the mixing chamber 35 provided in the toner storage 24 for preventing the toner returned through the transferring pipe 43 from flowing backward to the hopper 30.

A rotary valve 37 as a separating side stream restricting mechanism is disposed between the toner separating member 60 located near the developing device 4 and the toner storage buffer 47, a part of the developing device 4, for preventing the air-stream separated from the mixed fluid from flowing into the developing device 4, to thereby prevent toner scattering from the developing device 4.

The valve 36 (37) has a bladed wheel 36*b* (37*b*) with plural blades radially fixed to the periphery of a support shaft, and a housing 36*a* (37*a*) as a wall covering the bladed wheel. The bladed wheel 36*b* (37*b*) is rotatable inside the housing 36*a* (37*a*), according to the rotation of the support shaft.

If the edges of the bladed wheel 36*b* (37*b*) get contact with the inside wall of the housing 36*a* (37*a*), the toner enters the sliding portion between the edges and the inside wall, which possibly causes the toner to be melted and stuck. It is therefore preferable in order to avoid the toner sticking that the rotary valve 36 (37) has a minimum clearance ranging from 0.1 mm to 0.7 mm between the edge of the blade 36*b* (37*b*) and the inside wall of the housing 36*a* (37*a*).

In order to improve the effect of preventing the leak of mixed fluid, plural rotary valves may be preferably provided in series, and the bladed wheel preferably has 4 to 12 blades.

In this embodiment, the rotary valves 36 and 37 are simultaneously driven with the drive of the toner transferring screws 34 and 68, respectively. Here, the valve 36 (37) may not be driven with the feeding screw 34 (68) just at the same time, but be driven almost at the same time.

A description will now be given of a toner transferring process referring to FIGS. 2 to 4.

Toner amount in the toner hopper 30 is detected by the toner sensor 33 using a piezoelectric element. When a toner level becomes lower than the level detected by the sensor 33, the motor 38 is actuated to rotate the container 31, which allows the toner to be replenished into the hopper 30 through the opening 30*a*.

When a toner concentration of the developer within the developing device becomes lower than a predetermined value, a concentration sensor (not shown) detects the state. A controller 70, receiving a detection signal, rotates a screw 49 to replenish a toner to the developing device 4, which causes the toner in the toner storing buffer 47 to be supplied to the developing device 4. When the toner concentration returns to the predetermined value, the instruction to replenish the toner is cancelled, and a series of feeding operation stops.

The toner storing buffer 47 is provided with a piezoelectric sensor 44 to keep the toner amount constant. When the toner level is lowered, the sensor 44 transmits a signal to the controller 70, which instructs the drivers of pumps, screws, and rotary valves to be operated.

In detail, actuation of the motor 39 shown in FIG. 3 drives the stirring member 32 to stir the toner inside the hopper 30, and also drives the screw 34 to drop the toner into the mixing chamber 35. At the same time, the rotary valve 36 is actuated, and also pump motors 55*a* and 55*b* are energized to operate the pumps 501 and 502, respectively. The operation of the pumps 501 and 502 generates an air stream in the mixing chamber 35 to mix the toner and the air-stream, and feeds the mixed fluid to the separating member 60 through the transferring pipes 40 and 41 by feed force of the pump 501.

The toner separated by the separating member 60 is transferred by the screw 68, fed to the storing buffer 47 by simultaneous operation of the valve 37, and also supplied to the developing device 4. The mixed fluid of the toner and air-stream that is not separated is returned to the mixed chamber 35 through the transferring pipes 42 and 43 by feed force of the pump 502.

As described above, installation of the rotary valves prevents the returned mixed fluid from leaking outside, to thereby avoid inconvenience such as toner scattering as much as possible.

Accordingly, the following effects can be attained.

Even if the toner transferring amount is increased by using a large capacity of pump motor, toner scattering can be avoided.

Since the toner container (cassette), the toner storage, etc. can be disposed apart from the developing device, a large size of toner supplying apparatus can be installed, corresponding to customers that need volumes of printouts, for example, in a print-on-demand (POD) market.

Further, the number of feeding screws can be reduced as much as possible, thereby reducing the stress on the toner to a minimum.

It is also possible to design a machine body with higher flexibility for the layout of a toner supplying apparatus.

In the embodiment, the rotary valve 36 as a flow control mechanism is disposed between the toner hopper 30 and the mixing chamber 35, and also the valve 37 between the toner separating member 60 and the toner storing buffer 47, a part of the developing device 4. However, the valve may be positioned only at one side, for example, be provided only between the separating member 60 located near the developing device 4 and the storing buffer 47.

The bladed wheel in the rotary valve 36 (37) has 4–12 blades in the embodiment, but the number of the blades is not critical, and can be 2–3, or more than 12.

As an example of a plurality of rotary valves 36 or 37 which are arranged in series, the embodiment has two rotary valves 37, as shown in FIG. 2, but the number of the valves is not limited to this one. A plurality of rotary valves may be disposed at the storage side.

Figure 5:
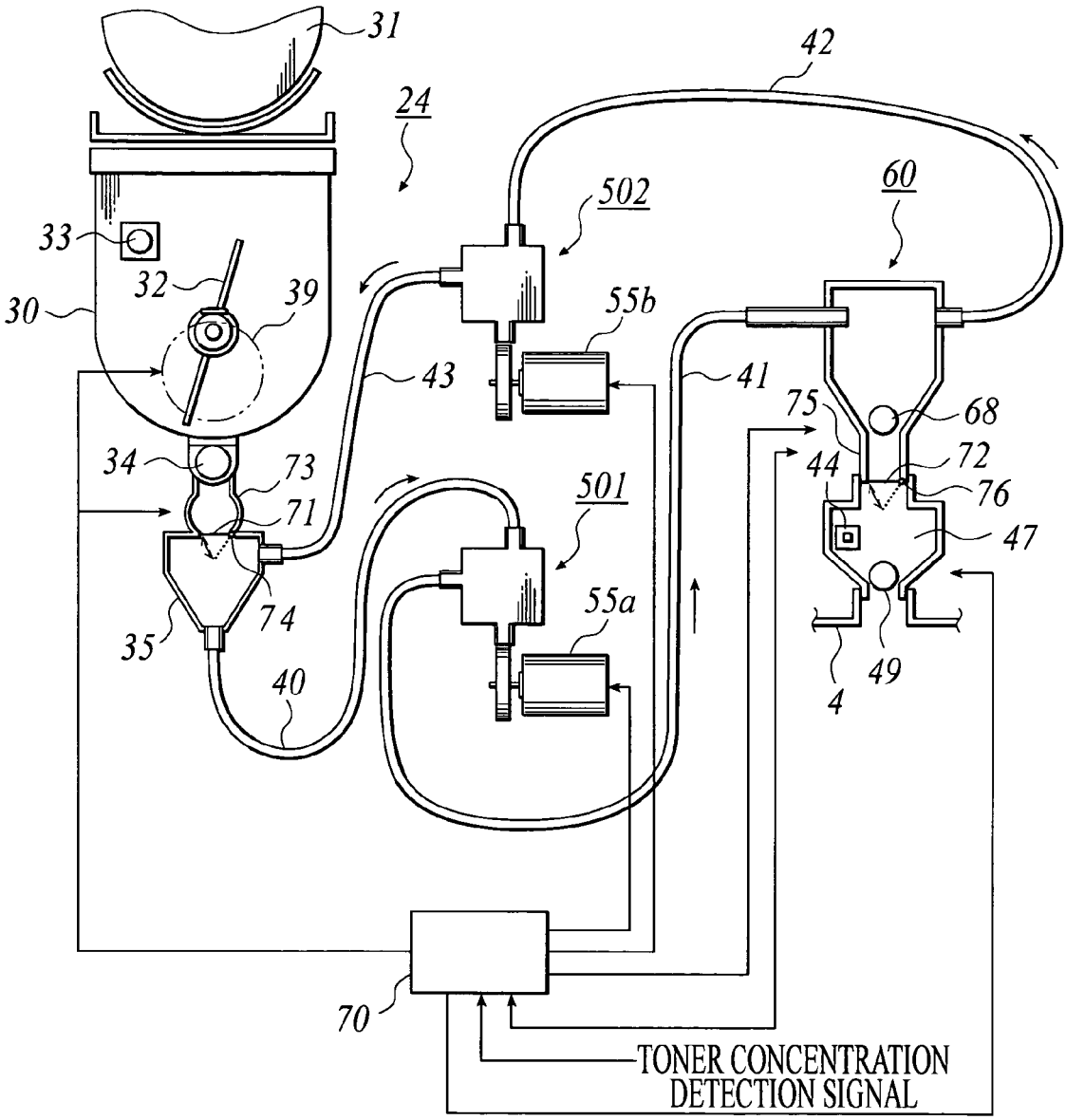
FIG. 5 illustrates a toner supplying apparatus according to a second embodiment of the present invention.

A description will be given of a second embodiment of a toner supplying apparatus according to the invention with reference to FIG. 5. The second embodiment differs from the first embodiment in a flow control mechanism, and other structure is common to both embodiments, therefore different points will be particularly explained.

The toner supplying apparatus of this embodiment has a gate valve 71 as a storage side flow control mechanism between the toner hopper 30 and the mixing chamber 35 in the toner storage 24 as in the first embodiment, and a gate valve 72 as a separating side flow control mechanism between the toner separating member 60 and the toner storing buffer 47.

In this embodiment, the flow control mechanisms 71 and 72 are the gate valves 71 and 72 provided at the entrance of the mixing chamber 35 and the toner storing buffer 47, respectively.

The storage side gate valve 71 has at one end a hinge 74 fixed to a housing 73 provided between the hopper 30 and the mixing chamber 35, and is rotatably supported on the housing 73 via the hinge 74. The valve 71 is always urged upward in FIG. 5 by a spring, not shown, so as to prevent the toner and air-stream from flowing into the mixing chamber 35. The valve 71 is provided with an open-close mechanism (not shown) for opening/closing the valve 71, which is rotatable, as indicated in FIG. 5, downward from the position to close an outlet of the housing. The downward rotation of the valve 71 allows the toner and air-stream piled on the valve to flow into the mixing chamber.

On the other hand, the separating side gate valve 72 has at one end a hinge 76 fixed to a housing 75 of the toner storing buffer 47, and is rotatably supported on the housing 75 via the hinge 76. The valve 72 is always urged upward in FIG. 5 by a spring, not shown, so as to prevent the toner and air-stream from flowing into the developing device 4. The valve 72 is provided with an open-close mechanism (not shown) for opening/closing the valve 72, which is rotatable, as indicated in FIG. 5, downward from the position to close an inlet of the storing buffer 47. The downward rotation of the valve 72 allows the toner and air-stream piled on the valve to fall into the developing device 4. At this time, the valve 72 is so controlled as to be released while the pump 501 for feeding the mixed fluid is halting. This control prevents the air-stream separated from the mixed fluid from flowing into the developing device 4, thereby preventing toner scattering.

The other parts of structure is the same as those of the first embodiment, therefore the locations and elements which are the same as corresponding ones are designated by the same reference numerals, and the description thereof is omitted.

A description will now be given of a toner supplying process referring to FIG. 5.

When the toner amount in the hopper 30 becomes lower than a certain level, the toner container 31 rotates to replenish the toner into the hopper 30 through the opening 30*a*.

By actuating the open-close mechanism of the gate valve 71, the toner supplied to the hopper 30 flows into the mixing chamber 35 with the valve 71 released. Then the pump 502 is actuated to supply the air-stream to the mixing chamber 35, to thereby mix the toner and the air-stream.

On the other hand, when the toner amount in the storing buffer 47 becomes lower than a certain level, driving the pump 501, the screw, and the like causes the toner to be fed from the mixing chamber 35 to the separating member 60, which separates the toner from the mixed fluid of the toner and air-stream. By actuating the open-close mechanism of the gate valve 72, the valve 72 pivotally rotates about the hinge 76, whereby the toner, which is separated from the air-stream and piled on the valve 72, falls into the storing buffer 47.

Further, when the toner concentration in the developing device 4 becomes lower than a predetermined value, the screw 49 rotates, causing the toner in the buffer 47 to be supplied to the developing device 4.

The gate valves 71 is arranged to have a clearance between the top end or the ends thereof and the wall of the mixing chamber 35 and of the housing 73. The gate valves 72 is arranged to have a clearance between the top end or the ends thereof and the wall of the storing buffer 47 and of the housing 75.

As described above, the installation of the gate valves 71 and 72 prevents the circulating mixed fluid from leaking outside, to thereby avoid defects such as toner scattering as much as possible.

As to alternatives, the invention is not limited to this embodiment as in the first embodiment.

Figure 6:
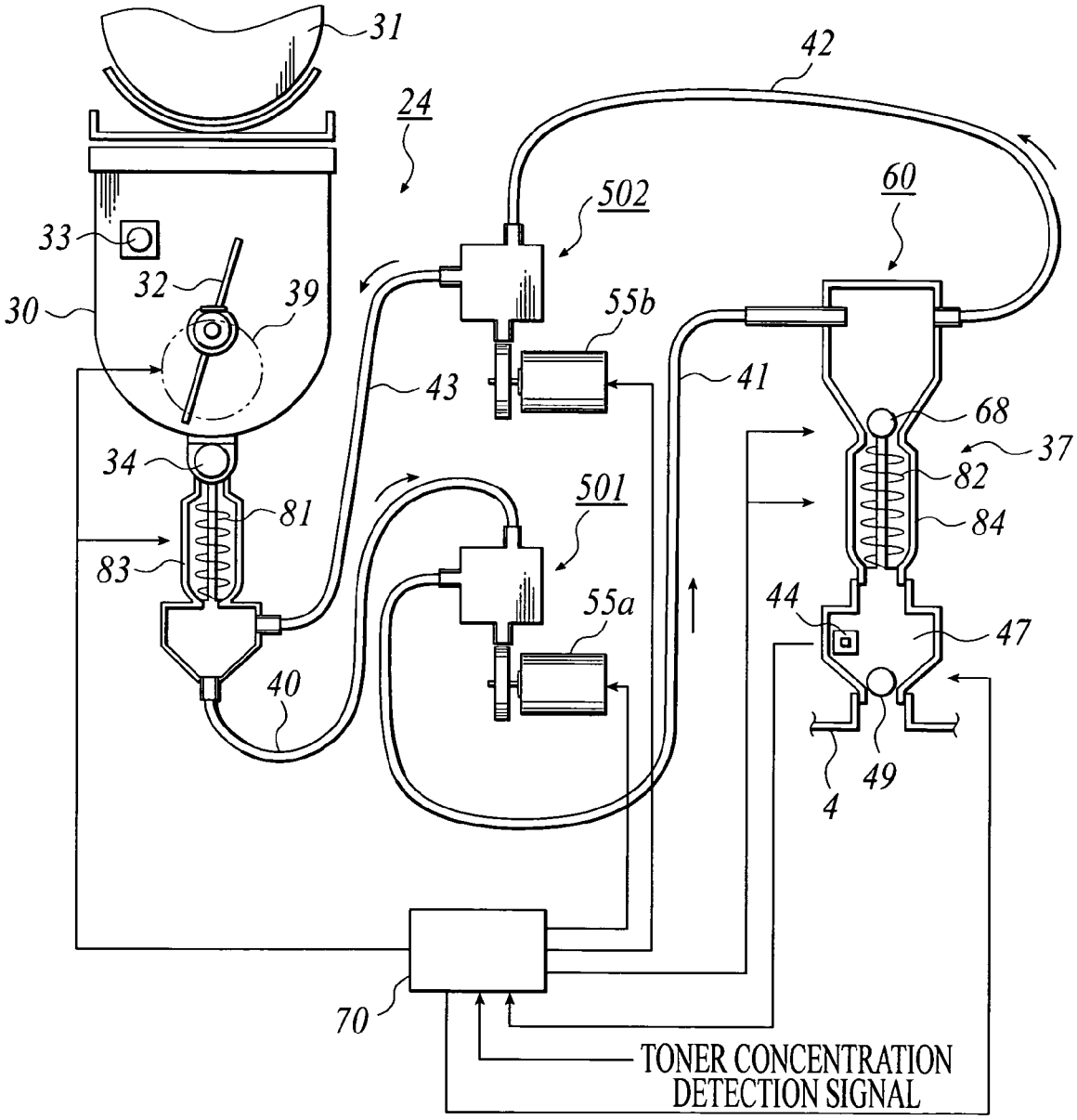
FIG. 6 illustrates a toner supplying apparatus according to a third embodiment of the present invention.

A description will now be given of a third embodiment of a toner supplying apparatus according to the invention with reference to FIG. 6. The third embodiment differs from the first and second embodiments in a flow control mechanism, and other structure is common to both embodiments, therefore different points will be particularly explained.

The toner supplying apparatus of this embodiment has a screw 81 as a storage side flow control mechanism between the toner hopper 30 and the mixing chamber 35 in the toner storage 24 as in the first embodiment, and a screw 82 as a separating side flow control mechanism between the toner separating member 60 and the toner storing buffer 47.

The storage side screw 81 is provided inside a housing 83 connected with the lower part of the hopper 30 so as to guide a toner from the hopper 30 to the mixing chamber 35.

On the other hand, the separating side screw 82 is provided inside the lower part of a housing 84 of the separating member 60 so as to guide the separated toner only to the storing buffer 47 while the separating member 60 separates the flowed-in mixed fluid into the toner and the air-stream.

The screws 81 and 82 include rotating shafts, which are rotatably attached inside the housings 83 and 84, respectively, and their rotors. The toner fed into the housing 83 (84) is transferred to a constant direction by the rotation of the rotor caused by the rotation of the rotating shaft. Meanwhile, if the edge of the rotor is in contact with the inside wall of the housing 83 (84), the toner possibly melts and sticks to the sliding contact portion. In order to avoid this toner sticking, the edge of the rotor preferably maintains a clearance of 0.1–0.7 mm with respect to the inside wall of the housing 83 (84).

The other parts of structure are the same as those of the first embodiment, therefore the locations and elements which are the same as corresponding ones are designated by the same reference numerals, and the description thereof is omitted.

A description will now be given of a toner transferring process referring to FIG. 6.

When the toner amount in the hopper 30 becomes lower than a certain level, the toner container 31 rotates to replenish the toner into the hopper 30 through the opening 30*a*.

Actuation of a drive motor for the storage side screw 81 rotates the rotor of the screw 81, which causes the toner fed from the hopper 30 to flow into the mixing chamber 35 little by little according to the rotation of the rotor. Further, by actuating the pump 502, the air-stream is supplied into the mixing chamber 35 to mix the toner and the air-stream.

On the other hand, when the toner amount in the storing buffer 47 becomes lower than a certain level, driving the pump 501, the screw, etc. causes the toner to be fed from the mixing chamber 35 to the separating member 60, which separates the toner from the mixed fluid. By actuating a drive motor for the separating side screw 82, the rotor of the screw 82 rotates, whereby the toner, which is separated from the air-stream and flows into the housing 84, falls into the storing buffer 47 little by little according to the rotation of the rotor.

Further, when the toner concentration in the developing device 4 becomes lower than a predetermined value, the screw 49 rotates, causing the toner in the buffer 47 to be supplied to the developing device 4.

As described above, the installation of the screws 81 and 82 prevents the circulating mixed fluid from leaking outside, to thereby avoid defects such as toner scattering as much as possible.

As to alternatives, the invention is not limited to this embodiment as in the first embodiment.

The entire disclosure of Japanese Patent Application No. 2003-163521 which was filed on Jun. 9, 2003, including specification, claims, drawings and abstract, is incorporated into the present invention in its entirety.

What is claimed is:

1. A toner supplying apparatus for supplying a mixed fluid containing a toner and an air stream to a predetermined position, comprising:

a toner separating member communicating to a developing device to develop a latent image on an image bearing member, which separates the toner from the mixed fluid;

a separating side flow control mechanism disposed between the toner separating member and the developing device;

a wall to cover at least a portion of the flow control mechanism, having a clearance therebetween; and an after-separation storage to store the toner separated from the mixed fluid.

2. The apparatus of claim 1, wherein the separating side flow control mechanism is a separating member side valve which comprises a movable member capable to reduce the air stream entering into the developing device and a shaft which the movable member can move based on.

3. The apparatus of claim 2, wherein the movable member is arranged to have a clearance of 0.1 mm to 0.7 mm between the wall and the movable member when an end of the movable member locates at a position closest to the wall.

4. The apparatus of claim 1, wherein the separating side flow control mechanism includes a bladed wheel having a plurality of blades, a screw or a gate valve.

5. The apparatus of claim 4, wherein the bladed wheel having blades, or the screw is arranged to have a clearance of 0.1 mm to 0.7 mm between the wall and the movable member when an end of the blades or an end of the screw locates at a position closest to the wall.

6. The apparatus of claim 1, wherein the separating side flow control mechanism is a bladed wheel having 4–12 blades.

7. The apparatus of claim 1, comprising at least two separating side flow control mechanisms.

8. The apparatus of claim 1, comprising at least two separating side flow control mechanisms in series.

9. The apparatus of claim 1, comprising:

a mixing chamber for mixing the toner and the air stream;

a first supply member to supply the mixed fluid containing the toner and the air stream to the toner separating member;

a first supply path for guiding the mixed fluid to the toner separating member;

a second supply member to return the toner which was not separated at the toner separating member, to the mixing chamber; and a second supply path for guiding the toner which was not separated to the mixing chamber.

10. The apparatus of claim 1, wherein the toner separating member is arranged near the developing device.

11. The apparatus of claim 1, further comprising a supply member to supply the toner separated from the mixed fluid to the separating side flow control mechanism, and the separating side flow control mechanism is driven at precisely or approximately the same time that the supply member is driven.

12. An image forming apparatus comprising:

a photoreceptor;

a developing device to develop a latent image on the photoreceptor with a toner;

a transferring device to transfer developed toner to an image support;

a fixing device to fix the toner on the image support; and a toner supplying apparatus as defined in claim 1.

13. A toner supplying apparatus for feeding a mixed fluid containing a toner and an air stream from a toner storage through a first supply path, by a first supply member, which comprises:

the toner storage including:

a toner hopper;

a mixing chamber;

a storage side flow control mechanism disposed between the toner hopper and the mixing chamber;

a wall to cover at least a portion of the storage side flow control mechanism, having a clearance therebetween; and a supply member, configured to transfer the toner from the toner hopper to the storage side flow control mechanism;

wherein the storage side flow control mechanism and the wall are configured to prevent the mixed fluid from flowing backward to the toner hopper.

14. The apparatus of claim 13, wherein the storage side flow control mechanism comprises a movable member capable of reducing the mixed fluid entering into the toner hopper and a shaft which the movable member can move based on.

15. The apparatus of claim 14, wherein the movable member is arranged to have a clearance of 0.1 mm to 0.7 mm between the wall and the movable member when an end of the movable member locates at a position closest to the wall.

16. The apparatus of claim 13, wherein the storage side flow control mechanism includes a bladed wheel having a plurality of blades, a screw or a gate valve.

17. The apparatus of claim 16, wherein the bladed wheel having blades, or the screw is arranged to have a clearance of 0.1 mm to 0.7 mm between the wall and the movable member when an end of the blades or an end of the screw locates at a position closest to the wall.

18. The apparatus of claim 13, comprising at least two storage side flow control mechanisms.

19. The apparatus of claim 13, wherein:

the mixing chamber is configured to mix the toner and the air stream, the first supply member is configured to supply the mixed fluid containing the toner and the air stream to a toner separating member, and the first supply path is configured to guide for guiding the mixed fluid to the toner separating member, and wherein the apparatus further comprises:

a second supply member configured to return the toner which was not separated at the toner separating member, to the mixing chamber; and a second supply path configured to guide the toner which was not separated to the mixing chamber.

20. The apparatus of claim 19, wherein the toner separating member is arranged near a developing device.

21. The apparatus of claim 13, wherein the storage side flow control mechanism is driven at precisely or approximately the same time that the supply member is driven.

22. The apparatus of claim 13, wherein the toner hopper comprises a sensor for detecting an amount of toner in the toner hopper, and the toner storage comprises a detachable toner container which supplies toner stored therein into the toner hopper when the sensor detects a predetermined level of the amount of toner in the toner hopper.

23. A toner supplying apparatus for feeding a mixed fluid containing a toner and an air stream from a toner storage which is disposed at a distance from a developing device, to a predetermined position through a first supply path, by a first supply member, comprising:

a toner separating member which is disposed near the developing device, to communicate to the developing device and to separate the toner from the mixed fluid;

a first valve including a movable member covered by a wall, disposed between the toner separating member and the developing device for preventing the air stream from separating from the mixed fluid flow into the developing device; and a second valve including a movable member covered by a wall, disposed between a toner hopper in the toner storage and a toner mixing chamber for Preventing the mixed fluid from flowing backward to the toner hopper.

24. The apparatus of claim 23, wherein each of the first and second valves comprises a movable member and a shaft which the movable member can move based on.

25. The apparatus of claim 24, wherein each of the first and second valves is arranged to have a clearance of 0.1 mm to 0.7 mm between the wall and the movable member when an end of the movable member locates at a position closest to the wall.

26. The apparatus of claim 23, wherein each of the movable members comprises a bladed wheel having a plurality of blades, a screw or a gate valve.

27. The apparatus of claim 26, wherein the bladed wheel having blades, or the screw is arranged to have a clearance of 0.1 mm to 0.7 mm between the wall and the movable member when an end of the blades or an end of the screw locates at a position closest to the wall.

28. The apparatus of claim 23, comprising at least two first valves each including the movable member, and at least two second valves each including the movable member.

29. The apparatus of claim 23, comprising at least two first valves in series, and at least two second valves in series.

30. A toner supplying apparatus for feeding a mixed fluid containing a toner and an air stream from a toner storage through a first supply path, by a first supply member, comprising:

a toner storage including:

a toner hopper;

a mixing chamber; and a storage side flow control mechanism disposed between the toner hopper and the mixing chamber, comprising:

a movable member capable of reducing an amount of mixed fluid entering into the toner hopper and a shaft which the movable member can move based on; and a wall configured to cover at least a portion of the movable member, and defining a clearance between the wall and the movable member;

wherein the movable member is arranged such that the clearance between the wall and the movable member is 0.1 mm to 0.7 mm when an end of the movable member is located at a position closest to the wall.

31. A toner supplying apparatus for feeding a mixed fluid containing a toner and an air stream from a toner storage which is disposed at a distance from a developing device, to a predetermined position through a first supply path, by a first supply member, comprising:

a toner separating member which is disposed near the developing device, to communicate to the developing device and to separate the toner from the mixed fluid;

a first valve disposed between the toner separating member and the developing device and including:

a movable member capable of reducing the air stream entering into the developing device;

a shaft which the movable member can move based on; and a wall covering the movable member; and a second valve disposed between a toner hopper in the toner storage and a toner mixing chamber and including:

a movable member configured preventing the mixed fluid from flowing backward to the toner hopper;

a shaft which the movable member can move based on; and a wall covering the movable member;

wherein each of the first and second valves is arranged to have a clearance of 0.1 mm to 0.7 mm between the wall and the movable member when an end of the movable member is located at a position closest to the wall.

* * * * *